US006807949B2

(12) United States Patent
Kishibata et al.

(10) Patent No.: US 6,807,949 B2
(45) Date of Patent: Oct. 26, 2004

(54) FUEL INJECTION AND IGNITION SYSTEM FOR INTERNAL COMBUSTION ENGINE

(75) Inventors: Kazuyoshi Kishibata, Numazu (JP); Yuichi Kitagawa, Numazu (JP); Hiroyasu Sato, Numazu (JP)

(73) Assignee: Kokusan Denki Co., Ltd., Shizuoka-ken (JP)

( * ) Notice: Subject to any disclaimer, the term of this patent is extended or adjusted under 35 U.S.C. 154(b) by 0 days.

(21) Appl. No.: 10/613,269

(22) Filed: Jul. 3, 2003

(65) Prior Publication Data

US 2004/0025839 A1 Feb. 12, 2004

(30) Foreign Application Priority Data

Aug. 9, 2002 (JP) ..... 2002-233330

(51) Int. Cl.[7] ..... F02D 41/00; F02D 43/00; F02P 5/00

(52) U.S. Cl. ..... 123/497; 123/490; 123/406.47; 123/179.17

(58) Field of Search ..... 123/497, 491, 123/478, 480, 490, 406.53, 406.56, 406.47, 179.17

(56) References Cited

U.S. PATENT DOCUMENTS 4,827,897 A * 5/1989 Yamada et al. ..... 123/497
4,881,105 A 11/1989 Davari et al. ..... 357/23.4
5,313,923 A * 5/1994 Takeuchi et al. ..... 123/497
5,555,872 A * 9/1996 Takeuchi et al. ..... 123/497
5,753,555 A 5/1998 Hada ..... 438/300
5,937,829 A * 8/1999 Endou ..... 123/497

FOREIGN PATENT DOCUMENTS

JP 2573118 3/1998
JP 2002-021624 1/2002

* cited by examiner

*Primary Examiner*—Weilun Lo
(74) *Attorney, Agent, or Firm*—Pearne & Gordon LLP

(57) ABSTRACT

A fuel injection and ignition system for an internal combustion engine adapted to apply a power source voltage to an injector, an ignition circuit, an electronic control unit and a fuel pump from a single voltage regulating power source circuit having as a power source a generator driven by the internal combustion engine through a power line and to control a drive current of the fuel pump in a pulse width modulating mode (PWM mode) so as to keep the power line voltage at a value higher than a reference voltage, which is set slightly higher than a voltage corresponding to one higher among the minimum operation voltages for the injector and that for the ignition circuit, in the course where the internal combustion engine starts.

24 Claims, 6 Drawing Sheets

FUEL INJECTION AND IGNITION SYSTEM FOR INTERNAL COMBUSTION ENGINE

TECHNICAL FIELD OF THE INVENTION

This invention pertains to a fuel injection and ignition system for an internal combustion engine used for supplying fuel to and igniting the internal combustion engine.

BACKGROUND OF THE INVENTION

Many vehicles such as a snowmobile, an outboard motor and a small two-wheeled vehicle have no battery mounted thereon. Of late, even an internal combustion engine driving such a vehicle having no battery mounted thereon has an electronically controlled fuel injection system (EFI) used as means to supply fuel and an ignition system including a microprocessor used to precisely control an ignition timing to ignite the engine for the purpose of purifying the exhaust gas and improving the startability of the engine.

In the fuel injection and ignition system for the internal combustion engine for driving the vehicle having no battery mounted thereon, there has been employed a power source system for applying a power source voltage to an injector, a fuel pump, an ignition circuit and a controller to control them from a magneto generator driven by the engine, which is referred to as "MAG power system" hereinafter.

The internal combustion engine for driving such a small-sized vehicle using the MAG power source system is adapted to be generally started by a starter such as a rope starter or a kicking starter using human power.

Since the rotational speed of a crankshaft of the engine cannot get enough high when it starts using the human power starter such as the rope starter or the kicking starter, the generator driven by the engine cannot generate the high voltage. Thus, there are provided individual power source systems for applying the respective power source voltages to the injector, the fuel pump, the ignition circuit and the controller in order to start the engine by the limited electric power generated by the generator so that the output characteristics of the respective power source systems are made proper whereby the extremely low speed rotation when the engine starts causes no fault in which the injector cannot be driven due to shortage of the electric power for the controller and the fuel having the predetermined amount of injection cannot be injected due to the shortage of the fuel pressure caused by shortage of the driving electric power for the fuel pump even though the injector can be in the condition of being able to be driven and thus the startability of the engine is improved.

Such a prior art in which the electric powers from the individual power source systems are applied to the injector and the controller as aforementioned is disclosed in Japanese Utility Model No. 2573118 (JP2573118U). In this document, although power sources for the fuel pump and the ignition circuit are not described, the commercially available fuel injection and ignition system having the idea embodied has individual power source systems from which the power source voltages are applied to the fuel pump and the ignition circuit, respectively.

An example of the practically used power source system is shown in FIG. 7. A magneto generator 1 having a rotor mounted on a crankshaft of the internal combustion engine is provided on the side of a stator with a generation coil 1*a* for driving a fuel pump FP, a generation coil 1*b* for driving an injector INJ, a generation coil 1*c* for driving an ignition circuit, a generation coil 1*d* for driving a controller ECU and a generation coil 1*e* for driving a car body electric load 3 such as head lamps. These generation coils are wound on one pole (tooth) or a plural of poles of an armature core in accordance with the amount of electric power required for the load to which the electric power is supplied.

The outputs of the generation coils 1*a* through 1*e* are converted into DC voltages by respective power source circuits 2*a* through 2*e* including a voltage regulating rectifier circuit and a power source capacitor Cd connected across the output terminals thereof and supplied to the fuel pump FP, the injector INJ, the ignition circuit including an ignition coil IG, the controller ECU and the car body electric load 3, respectively. The controller ECU comprises a microprocessor MPU for arithmetically operating the ignition timing and the amount of fuel injection and, in addition thereto, comprises a switch Qf to control the energization of the fuel pump FP, a switch Qj to control the energization of the injector INJ and a switch Qi to the energization of a primary coil of the ignition coil IG. In the illustrated example, the ignition circuit is constituted by the ignition coil IG and the switch Qi.

Although, in the example shown in FIG. 7, the power source circuits 2*a* through 2*e* are provided separately from the controller ECU, in some case, the power source circuits 2*a* through 2*e* may be collectively formed with the controller ECU so as to form a single unit.

With the construction shown in FIG. 7, the controller can be operated at the extremely low speed of the engine by getting the proper output characteristic of each of the power source circuits 2*a* through 2*e* so as to perform the fuel injection and the ignition, which causes the startability of the engine to be improved.

However, in the construction of FIG. 7, there are required many generation coils having different characteristics in the single generator so that the power source circuit is provided for each of the generation coils. This causes the following problems;

(a) Since the winding operation should be made while copper wire is changed for every generation coil, the winding operation of the generator is troublesome, which causes the higher manufacture cost of the generator.

(b) Since many generation coils require the respective terminal treatment, this needs a number of steps for the terminal treatment, which also causes the higher manufacture cost of the generator.

(c) Since the number of the wires of the wire harness led out from the generator increases, the laying operation of the wire harness gets troublesome.

(d) Since the number of the power source circuits increases, the cost of the power source section gets higher.

The vehicles such as the snowmobiles or ATVs (buggies) considered to be used in the out-of-the-way places or the vehicles such as the motorboats having a possible accident, which would occur if the engine stops, are preferably in the condition where the internal combustion engine can be operated even in the case where the batteries cannot be used.

The MAG power source system is the one excellently used for the case where the engine is laid under such a circumstance of extremely low temperature as cannot guarantee an output of a battery enough to enable the fuel injection system and the ignition system to be driven without relying on the battery after the engine starts and before it is steadily operated or the case where the engine is required to be operated even though the battery is deteriorated.

However, since the prior MAG power source system has a number of power source circuits as shown in FIG. 7, the system could be inevitably more expensive than the ordinary power source system having the battery used.

In Japanese Patent Application Laid-Open Publication No. 2002-21624 (JP2002-21624A), it is disclosed a start control system in which a power source section is so constructed that the fuel pump, the injector and the ignition system can be driven by a single power source circuit having a generator used as a power source and in which, when the engine starts, the fuel pump, the injector and the ignition system never serve simultaneously as the load to the power source circuit by stopping the operation of the fuel pump when the injector and the ignition system are driven in the course of starting the engine.

According to the start control system disclosed in JP2002-21624A, since the number of the power source circuits provided in the power source section can be decreased, the cost of the system can be reduced.

However, in this system, since the operation of the fuel pump stops when the fuel should be injected in the course of starting the engine, and the fuel is injected by the fuel pressure previously accumulated in a fuel pipe system before the injection of the fuel, the amount of fuel injection will be less than the desired amount of fuel injection according to the accumulated fuel pressure. This causes the ratio of air to fuel of the mixture gas to get leaner and therefore the startability of the engine to be possibly deteriorated.

In the case where the fuel pump is adapted to stop when the fuel injection and the ignition operation are performed at the time of starting the engine, the fuel pump is intermittently driven in the course of starting the engine. Thus, when the engine is started after the engine stops for long time, it will take substantial time for the fuel pressure applied to the fuel injector to increase to the normal value whereby the startability of the engine is possibly deteriorated because of the insufficient amount of fuel injection when the engine should be started.

SUMMARY OF THE INVENTION

Accordingly, it is a principal object of the invention to provide a fuel injection and ignition system for an internal combustion engine in which the number of power source circuits provided in a power source section can be decreased so as to reduce the cost of the system and the startability of the engine can be improved without any possible insufficient of amount of fuel injection when the engine should be started.

This invention pertains to a fuel injection and ignition system for an internal combustion engine comprising an injector to supply fuel to the internal combustion engine, an ignition circuit to generate an ignition high voltage to be applied across an ignition plug provided in a cylinder of the internal combustion engine, a controller to control at least the injector and the ignition circuit and a power source section having an AC generator as a power source to apply a power source voltage to the injector, the fuel pump, the ignition circuit and the controller.

In the invention, the power source section is adapted to apply the power source voltage from a single voltage regulating power source circuit through a power source line to the controller and the fuel pump and at least one of the injector and the ignition circuit.

The controller comprises pump drive current control means to control a drive current for the fuel pump in a PWM mode so as to maintain the power source line voltage at a reference voltage or more, which is determined at a voltage or more corresponding to the minimum operation voltage of the elements other than the fuel pump, in the course of starting the engine.

With the common single power source circuit provided for the controller and the fuel pump and at least one of the injector and the ignition circuit, the number of the power source circuits provided in the power source section can be reduced and therefore the cost of the system can be decreased. Also, the number of the generation coils provided in different systems of the generator can be reduced, the number of winding operation of the generator can be decreased, which reduces the number of the harness led out of the generator whereby the generator can be inexpensive.

Furthermore, with the aforementioned construction, since the operation of the fuel pump can be continued even when the fuel injection and the ignition operation are performed in the course of starting the engine, there can be prevented the possible insufficient fuel pressure, which tends to occur in the prior art in which the fuel pump stops when the fuel injection and the ignition operation are performed in the course of starting the engine. Therefore, there can be prevented the state where the amount of fuel injection becomes insufficient when the engine should be started, which can always accomplish the improved startability of the engine.

In a preferred embodiment of the invention, the power source section is adapted to apply the power source voltage from a single voltage regulating power source circuit having a generator as a power source through the power source line to the injector, the ignition circuit, the controller and the fuel pump.

In this case, the pump drive current control means of the controller controls the drive current for the fuel pump in the PWM mode so as to maintain the power source line voltage at the reference voltage or more, which is determined at the voltage or more corresponding to the higher minimum operation voltage among those of the injector and the ignition circuit.

According to the invention, since the power source voltage from the single power source circuit can be applied to the injector, the ignition circuit, the controller and the fuel pump, which are the fundamental elements essential for the operation of the internal combustion engine, the power source section can be constructed in a simpler manner than the one in which the electric power is applied to one of the injector and the ignition circuit through the other element.

In the invention, in the case where the power source voltage is applied from the same power source circuit as the one which applies the power source voltage to the fuel pump and the controller to only one of the injector and the ignition circuit, the power source voltage is adapted to be applied to the other element of the injector and the ignition circuit through a circuit of system different from the system of the power source circuit. With the system constructed as aforementioned, the construction of the power source section can be more remarkably simplified than the prior fuel injection and ignition system in which there are provided the individual power source systems for the injector, the fuel pump, the ignition circuit and the controller, respectively.

In a further preferred embodiment of the invention, a load or loads such as a lump load other than the injector, the ignition circuit, the controller and the fuel pump is connected through energization control switch means to the power source line. In this case, the controller may further comprise, in addition to the aforementioned pump drive current control means, energization control switch means to control an energization control switch in a PWM mode so as to provide an off state of the energization control switch when the engine should be started and to maintain the power source line voltage at an objective voltage set at the reference voltage or more after finishing the start of the engine.

The power source circuit comprises a control rectifier circuit of a hybrid bridge circuit of diodes and thyristors, from which the power source voltage is output to the power source line. In this case, in the power source section or the controller, it may be provided thyristor control means to control the thyristors so as to limit the power source line voltage to a predetermined limited value or less.

In the case where the generator comprises a magneto generator, a voltage regulation to lower the output voltage of the generator to the limited value or less can be performed by shorting the output of the generator when the output voltage of the generator gets excessive. Thus, in this case, the power source circuit may comprise a rectifier circuit to rectify the output voltage of the generator and an output shorting switch to short the output of the generator so as to output the power source voltage from the rectifier circuit to the power source line.

In this case, in the power source section or the controller, it is provided output shorting switch control means to control the output shorting switch so as to short the output of the generator when the power source line voltage exceeds the predetermined limited value.

The aforementioned power source circuit may comprise a rectifier to rectify an output current of the generator and a chopper switch to intermittently flow the output current of the generator whereby the voltage rectified by the rectifier and regulated by the chopper switch is output to the power source line.

In this case, in the power source section or the controller, it is provided chopper control means to control the chopper switch so as to rise the power source line voltage when the voltage of the power source line is lower than the predetermined limited value due to the lower rotational speed of the internal combustion engine and to lower the power source line voltage when the power source line voltage is higher than the limited value.

With the system constructed as aforementioned, since there can be fed the DC voltage higher than a crest value of the output voltage of the generator to the power source line by rising the output voltage of the generator, the starting rotational speed of the engine or (the rotational speed when the fuel injection and the ignition start) can be lowered whereby the startability of the engine can be improved.

BRIEF DESCRIPTION OF THE DRAWINGS

The above and other objects and features of the invention will be apparent from the detailed description of the preferred embodiments of the invention, which is described and illustrated with reference to the accompanying drawings, in which.

DETAILED DESCRIPTION OF PREFERRED EMBODIMENTS

Now, the embodiments of the invention will be illustrated and described with reference to FIGS. 1 through 6.

Figure 1:
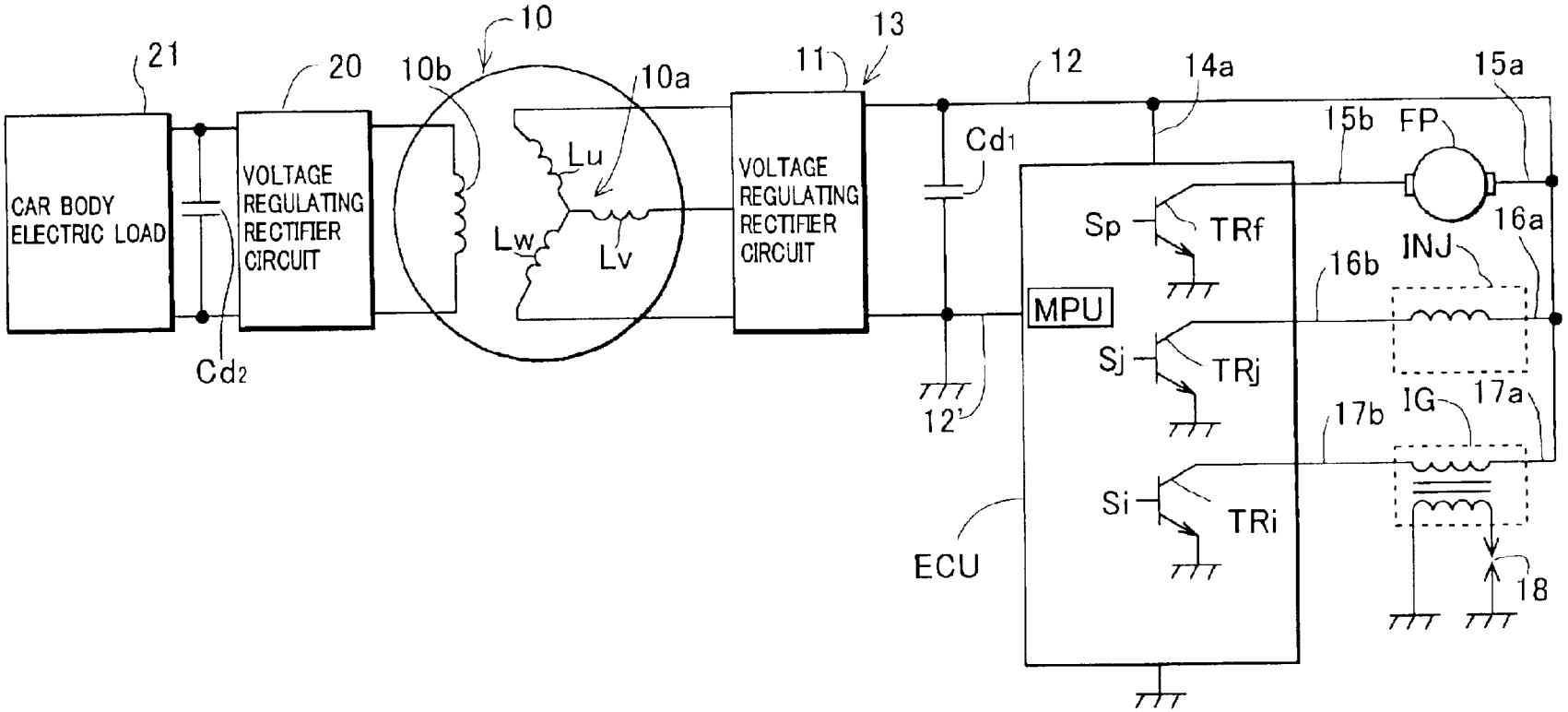
FIG. 1 is a schematic diagram of a fuel injection and ignition system for an internal combustion engine constructed in accordance with a first embodiment of the invention.

FIG. 1 illustrates a fuel injection and ignition system constructed in a first embodiment of the invention. There is illustrated in FIG. 1 a magneto generator 10 mounted on an internal combustion engine not shown to drive a vehicle such as a snowmobile. The magneto generator 10 may comprise a magnet rotor provided on a crankshaft of the engine and a stator including generation coils wound on salient poles of a multi-polar star-like armature core having an annular yoke and many salient poles (teeth) protruding from a periphery of the yoke in a radial manner. This generator is of conventional type, which is generally used as a generator mounted on the internal combustion engine.

In the embodiment, on the stator of the generator 10, there are provided three-phase generation coil 10*a* formed of three phase coils Lu through Lw star-connected and a single-phase generation coil 10*b*. The three-phase generation coil 10*a* is used as a power source for driving a fuel pump FP, an injector INJ, an ignition circuit including an ignition coil IG and a controller ECU, which are fundamental elements essential for operating the internal combustion engine. The single phase generation coil 10*b* is used as a power source for driving an electric load (referred to as car electric load later) such as lamps mounted on a car.

An output of the three-phase generation coil 10*a* is input to a voltage regulating rectifier circuit 11 having output terminals across which a smoothing capacitor Cd1 is connected. The voltage regulating rectifier circuit 11 may be of such as a conventional type as comprises a three-phase diode bridge full-wave rectifier circuit to rectify the output of the generation coil 10*a* and convert it into a DC voltage to feed it to the power source line 12, an output shorting switch to short the output of the generator in its on state and output shorting switch control means to control the output shorting switch so as to short the output of the generation coil 10*a* when the output voltage of the rectifier circuit exceeds a limited value, for example. The voltage regulating rectifier circuit serves to convert the AC output of the generation coil 10A into the DC output and outputs to the power source lines 12 and 12' the DC voltage regulated so as not to exceed the limited value.

In this embodiment, the voltage regulating rectifier circuit 11 and the capacitor Cd1 constitute a power source circuit 13 having the generator 10 as a power source to output the regulated DC voltage to the power source lines 12 and 12' and the generation coil 10*a*, the power source circuit 13 and the power source line 12 and 12' constitute one power source system.

The power source line 12' led out of the negative output terminal of the rectifier circuit among the power source lines 12 and 12' led out of the rectifier circuit 11 is grounded to earth. In the specification, what is referred to as "the power source line" is the power source line 12 on the ungrounded side.

The power source line 12 led out of the positive output terminal of the rectifier circuit 11 is connected to an ungrounded power source terminal 14*a* of the controller ECU and also connected to one of power source terminals 15*a* of the fuel pump FP, one of power source terminals 16*a* of the injector INJ, to which fuel is given from the fuel pump FP and one end 17*a* of a primary coil of the ignition coil IG.

The other power source terminal 15*b* of the fuel pump FP is connected to a collector of an NPN transistor TRf having an emitter grounded and provided in the controller ECU, while the other power source terminal 16*b* of the injector INJ is connected to a collector of an NPN transistor TRj having an emitter grounded and provided in the controller ECU in the same manner as the power source terminal 15*b*. The other end of the primary coil of the ignition coil IG is connected to a collector of an NPN transistor TRi having an emitter grounded and provided in the controller ECU, and a secondary coil of the ignition coil IG is connected to an ignition plug 18 provided in a cylinder of the engine not shown.

In the illustrated embodiment, the transistor TRf serves as a pump drive switch to turn on or off the drive current of the fuel pump, and the transistor TRj serves as an injector drive switch. Also, the transistor Tri serves as a primary current control switch to control the primary coil of the ignition coil IG. The transistor Tri and the ignition coil IG constitute a conventional current interruption ignition circuit.

In this ignition circuit, the transistor Tri gets an on state at the time prior to the ignition timing and gets an off state at the ignition timing. When the transistor Tri gets the on-state, the primary current of the ignition coil IG flows from the power source line 12 through the primary coil of the ignition coil IG and the transistor Tri whereby an energy is stored in the ignition coil IG. When the transistor Tri gets the off state, the current flowing through the primary coil of the ignition coil is interrupted; and therefore, a high voltage is induced across the primary coil of the ignition coil IG. Since this voltage is boosted by a winding ratio of the secondary coil to the primary coil of the ignition coil IG, an igniting high voltage is induced across the secondary coil of the ignition coil IG. This igniting high voltage is applied across the ignition plug 18; and therefore, a spark discharge occurs at the ignition plug 18 whereby the engine is ignited.

The injector INJ comprises an injector body to which fuel is given from the fuel pump FP, a needle valve to open and close an injection opening formed at an end of the injector body and a solenoid to drive the needle valve. This injector serves to open the injection opening while predetermined drive current flows through the solenoid to inject the fuel into a fuel injection space of the internal combustion engine.

What is referred to as "fuel injection space" is a space such as one in an intake pipe of the engine or one in a cylinder of the engine where the fuel is injected from the injector. The amount of fuel injected from the injector (the fuel injection amount) is determined on a pressure under which the fuel is given from the injector and a time for which the fuel is injected (fuel injection time). Since the pressure under which the fuel is given from the injector is kept at a constant value by a pressure adjuster, the fuel injection amount is managed by the fuel injection time.

The controller ECU comprises a microprocessor MPU and a control power source circuit to generate a power source voltage (5V) for driving the microprocessor by reducing the voltage of the power source line 12, in addition to the switches such as the transistors TRf, TRj and Tri to control the energization of the fuel pump, the injector and the ignition coil. The controller ECU accomplishes various function realization control means such as rotational speed arithmetical operation means to arithmetically operate the rotational speed of the engine, ignition timing arithmetical operation means to arithmetically operate the ignition timing of the engine relative to various control conditions including the arithmetically operated rotational speed, injection time arithmetical operation means to arithmetically operate the fuel injection time relative to various control conditions such as the rotational speed, the temperature of the engine, an opening degree of a throttle valve, an atmospheric pressure and so on and pump drive current control means to control the drive current of the fuel pump FP in a PWM mode so as to keep the power source line voltage at the value corresponding to the minimum operating voltage of the injector and the ignition circuit or more in the course where the internal combustion engine starts.

The output of the other generation coil 10*b* provided in the generator 10 is input to the voltage regulating rectifier circuit 20 having the output terminals across which the smoothing capacitor Cd2 is connected. The car body electric load 21 such as lamps is connected across the output terminals of the rectifier circuit 20. The generation coil 10*b* and the rectifier circuit 20 constitute another power source system.

The voltage regulating rectifier circuit 20 is constructed in a manner similar to the voltage regulating rectifier circuit 11. The regulated DC voltage is applied from the generation coil 10*b* through the rectifier circuit 20 to the car body electric load 21.

In the embodiment illustrated in FIG. 1, the generator 10 and the rectifier circuits 11 and 20 constitute the power source section to apply the power source voltage to the fundamental elements essential for operating the internal combustion engine and the car body electric load. The power source section includes two electric systems, one of which applies the voltage to the fuel pump, the injector, the ignition circuit and the controller and the other of which applies the power source voltage to the car body load.

In this invention, the output characteristics of the generation coil 10*a* (based on the number of windings of the generation coil and the conductor cross section thereof) is so set that the generation coil 10*a* to supply the electric power to the controller ECU, the fuel pump FP, the injector INJ and the ignition circuit which are essential for operating the internal combustion engine can generate the output enabling to drive at least the controller ECU and the element requiring the largest electric power at the same time in the course of starting the engine.

The drive current of the fuel pump FP is in the condition of being controlled in the PWM mode with a variable duty by turning on and off the pump drive switch (transistor TRf), and the drive current of the fuel pump is controlled in the PWM mode so that the voltage of the power source line 12 is kept at the reference voltage or more, which is set at slightly higher than the higher one among the minimum operation voltages necessary for operating the injector and the ignition circuit, respectively.

Figure 6:
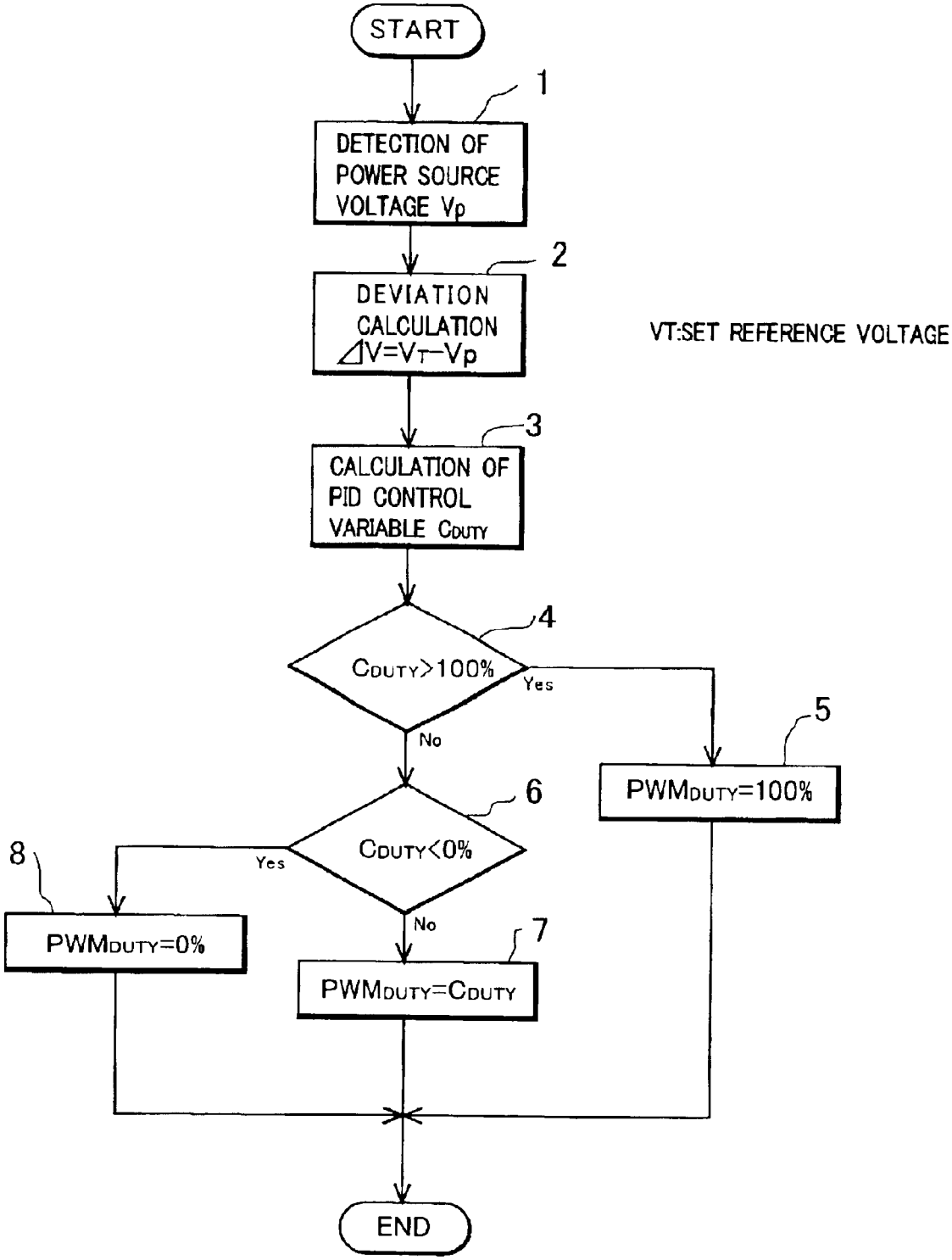
FIG. 6 is a flow chart illustrating an algorithm of one task of a program practiced by a microprocessor of the controller in the embodiment of FIG. 1.
Figure 7:
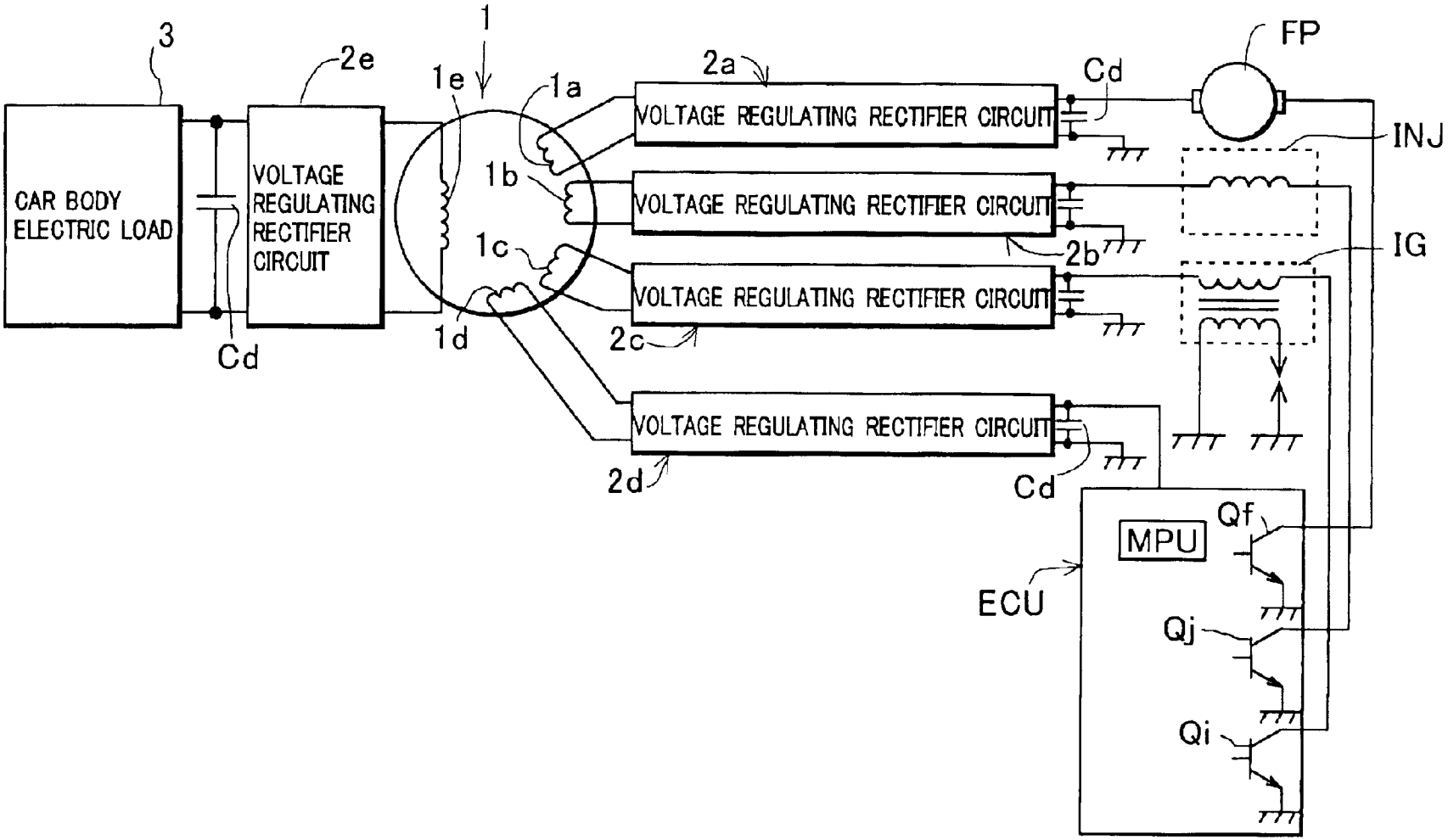
Fig. 7 Prior Art
FIG. 7 is a schematic diagram of the prior art fuel injection and ignition system.

There is shown in FIG. 6 a flow chart illustrating algorithm for accomplishing the pump drive current control means to control the drive current of the fuel pump, which is one of a series of tasks executed by the microprocessor MPU of the controller ECU.

In the algorithm of FIG. 6, in a step 1, the voltage Vp of the power source line is detected, and then in a step 2, a deviation ΔV between the detected voltage and the reference voltage Vt is arithmetically operated. In a step 3, the PID calculation is applied to the deviation ΔV to provide the PID control variable $C_{DUTY}$. The control variable $C_{DUTY}$ is expressed by the following formula wherein the proportional gain is $K_p$, the integral gain is $K_i$ and the differential gain is $K_d$.

$$C_{DUTY}=K_P\times\Delta V_n+K_I\times(\Delta V_n+\Delta V_{n-1}+\ldots)+K_D\times(\Delta V_n-\Delta V_{n-1})$$

Thereafter, in a step 4, whether the control variable $C_{DUTY}$ exceeds 100% or not is determined. If it is determined to exceed 100%, then in a step 5, the $PWM_{DUTY}$ is set at 100%.

In the step 4, if it is determined not to exceed 100%, then in a step 6, whether the control variable $C_{DUTY}$ is negative or not is determined. If it is determined to be positive, then in a step 7, the control variable $C_{DUTY}$ is set at the $PWM_{DUTY}$. In the step 6, if it is determined to be negative, in a step 8, the $PWM_{DUTY}$ is set at 0%.

The microprocessor controls the drive current of the fuel pump by turning on and off the transistor TRf with a duty ratio set at the $PWM_{DUTY}$. The routine shown in FIG. 6 is repeated every given time.

Figure 5:
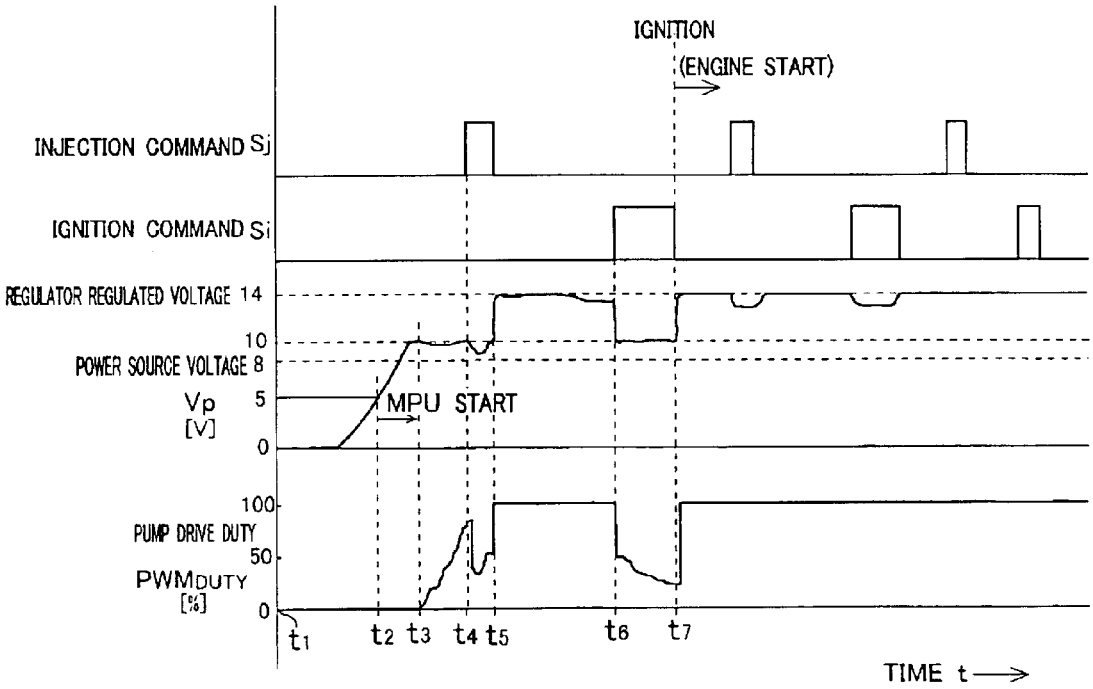
FIG. 5 is a time chart for explaining the operation of the fuel injection and ignition system constructed in accordance with the invention.

The practical operation of the illustrated system will be now described with reference FIG. 5. In the illustrated embodiment, the minimum operation voltage of the injector and the ignition circuit is supposed to be 8V and the aforementioned reference voltage is set at 10V. The voltage regulating rectifier circuit 11 outputs the regulated DC voltage having the limited value of 14V to the power source line 12. In other words, when the engine is operated in the steady state so that the output of the generator gets fully high, the power source voltage of 14V is output from the rectifier circuit 11 to the power source line 12.

When a starter such as a recoil starter is operated at time t1 to start a cranking operation of the internal combustion engine, the power source voltage Vp output to the power source line 12 increases as the rotational speed rises. When the power source voltage Vp exceeds the operation voltage of the microprocessor at time t2, the microprocessor in the ECU is started. The microprocessor initializes their parts after its start and begins the operation thereof. At this time, since the power source voltage does not reach the reference voltage 10V, the $PWM_{DUTY}$ has the initial value "0" left. Thus, the transistor TRf is in the off state, and the fuel pump FP is not driven.

The power source voltage Vp rises as the rotational speed increases and when the power source voltage Vp exceeds the reference voltage 10V at time t3, the $PWM_{DUTY}$ also increases. Thus, since the drive signal Sp for intermittently driving the transistor TRf with the duty ratio of $PWM_{DUTY}$ is applied to the transistor TRf, the operation of the pump begins. The fuel pressure rises in connection with this.

When the predetermined injection timing t4 comes, the microprocessor applies the injection command Sj to the base of the transistor TRj so as to get the on state thereof. Thus, the injector INJ is energized so that the injection of fuel starts. At this time, if the generated electric power of the generator is not enough, the power source voltage will get lower than the reference voltage. When the power source voltage Vp descends, the duty ratio $PWM_{DUTY}$ of the drive current of the fuel pump is lowered by the aforementioned control so that the drive current of the fuel pump FP decreases. This decreases the electricity consumption of the generator whereby the power source voltage is returned to the reference voltage. Although, at this time, the emission amount of the fuel pump is lowered, the operation of the fuel pump continues and the fuel pressure is accumulated in the fuel pipe. Thus, it will be noted that the fuel pressure at the fuel injection is seldom lowered; and therefore, the fuel of the predetermined amount can be injected from the injector. When the injection command disappears at time t5, the transistor TRj gets the off state so that the energization of the injector terminates, and the power source voltage Vp is returned to the reference voltage 10V or more. At this time, the $PWM_{DUTY}$ becomes 100%, and the duty ratio of the drive current of the fuel pump becomes 100%.

Thereafter, when a timing t6 for energizing the primary coil of the ignition coil IG comes, the ignition command Si is given the transistor TRi so that the energization of the primary coil of the ignition coil IG starts. Generally, the electricity consumption of the ignition coil is larger than that of the injector, and the drive current of the injector is approximately 1A while the primary current of the ignition coil reaches approximately 4A at its saturation. Since the current flowing through the ignition coil increases as the energy is accumulated into the ignition coil, the power source voltage tends to be lowered, but the duty ratio $PWM_{DUTY}$ of the drive current of the fuel pump decreases as the power source voltage is lowered; and therefore, the power source voltage is so controlled as to be returned to the reference voltage. When the ignition timing at the initiation of the engine comes at time t7, the ignition command applied to the transistor TRi disappears; and therefore, the transistor TRi gets the off state, which interrupts the primary current flowing through the ignition coil until now. Thus, the igniting high voltage is induced across the secondary coil of the ignition coil, and the engine is ignited and therefore starts. Since the electrical interruption of the ignition coil returns the power source voltage Vp to the reference voltage or more, the duty ratio $PWM_{DUTY}$ of the drive current of the fuel pump FP gets 100%.

As the rotational speed of the internal combustion engine is abruptly increased by the initial explosion of the engine, the output of the generator 10 is also increased. Thus, since the power source voltage having the value of the reference voltage or more can be maintained when the injector INJ and the ignition coil IG are driven, the duty ratio $PWM_{DUTY}$ of the drive current of the fuel pump has 100% kept.

Although, in the embodiment illustrated in FIG. 1, the power source voltage is applied to the injector INJ and the ignition circuit from the power source circuit for applying the power source voltage to the fuel pump FP and the controller ECU, one of the injector INJ and the ignition circuit may be connected to the power source line 12 and the power source voltage may be applied to the other through the separate power source circuit from the generator 10. For example, to the power source line 12, only the controller ECU, the fuel pump FP and the injector INJ may be connected, and for the ignition circuit comprising the ignition coil IG and the primary current control circuit, a separate generation coil may be provided in the generator so that the power source voltage can be applied from the separate generation coil to the ignition circuit.

Figure 2:
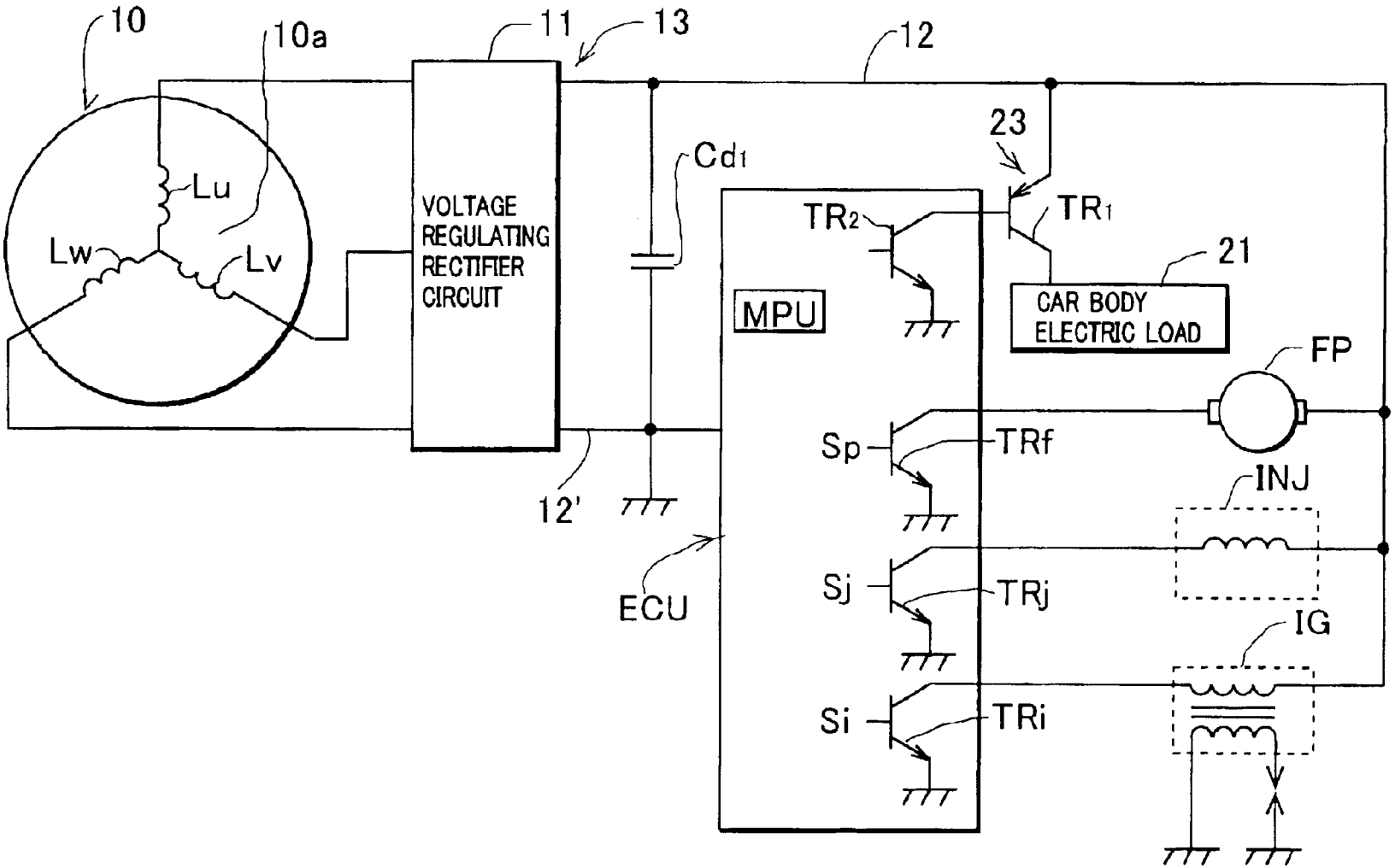
FIG. 2 is a schematic diagram of a fuel injection and ignition system for an internal combustion engine constructed in accordance with a second embodiment of the invention.

Although, in the aforementioned embodiment, the power source voltage is applied to the car body electric load 21 through the circuit separate from the power source circuit 13 for driving the fuel pump and the controller, the electric power may be supplied to the car body electric load from the power source circuit 13 for applying the power source voltage to one of the ignition circuit and the injector, the fuel pump FP and the controller ECU. In this case, as shown in FIG. 2, the car body electric load 21 is connected to the power source line 12 through an energization control switch 23 comprising a PNP transistor TR1 and so on. In addition thereto, there should be provided in the controller ECU energization switch control means to keep the off state of the energization control switch 23 when the internal combustion engine should be started and to control the energization control switch 23 in a PWM mode after the internal combustion engine starts so as to keep the voltage of the power source line 12 at an objective voltage set at higher than the reference voltage.

In the embodiment illustrated in FIG. 2, an NPN transistor TR2 having a collector connected to the base of the transistor TR1 and an emitter grounded is provided in the controller ECU. A drive signal modulated in the PWM mode is applied from the microprocessor to the base of the transistor TR2 so as to control the energization control switch 23 in the PWM mode.

In the fuel injection and ignition system shown in FIG. 2, in the course of starting the internal combustion engine, the drive current of the fuel pump FP is so controlled in the PWM mode as to keep the voltage of the power source line 12 at the reference voltage or more. After the internal combustion engine starts, the energization control switch TR1 is so controlled in the PWM mode as to keep the voltage of the power source line 12 at the objective voltage or more set at higher than the reference voltage.

With the construction aforementioned, since the distribution of the electric power to the car body electric load can be limited when the car body electric load is too large and the power source voltage is lowered, the controller, the fuel pump, the injector and the ignition circuit can be prevented from their malfunction.

With the car body electric load adapted to be driven by the power source circuit 13 for driving the controller, the fuel pump, the injector and the ignition circuit as shown in FIG. 2, the winding system provided in the generator can be a single one and also only one voltage regulating rectifier circuit may be provided. This enables the MAG power source system to be adopted by providing the minimum cost difference between the illustrated system and the system using the battery power source.

In the illustrated embodiments, there are provided, in the power source section, the rectifier circuit to rectify the output voltage of the generator 10, the output shorting switch to short the output of the generator and the output shorting switch control means to control the output shorting switch so that the output of the generator is shorted when the voltage of the power source line exceeds the limited value. However, only the rectifier circuit and the output shorting switch may be provided in the power source section, and the output shorting switch control means may be provided in the controller ECU.

It should be noted that the invention is never limited to the case where the power source circuit as described above is used. For example, it may be used a power source circuit which comprises a control rectifier circuit including the hybrid bridge circuit of diodes and thyristors so as to output the power source voltage from the control rectifier circuit to the power source line. In this case, there is provided thyristor control means in the power source section or the controller ECU to control the thyristors so as to limit the voltage of the power source line to the predetermined limit value or less.

Figure 3:
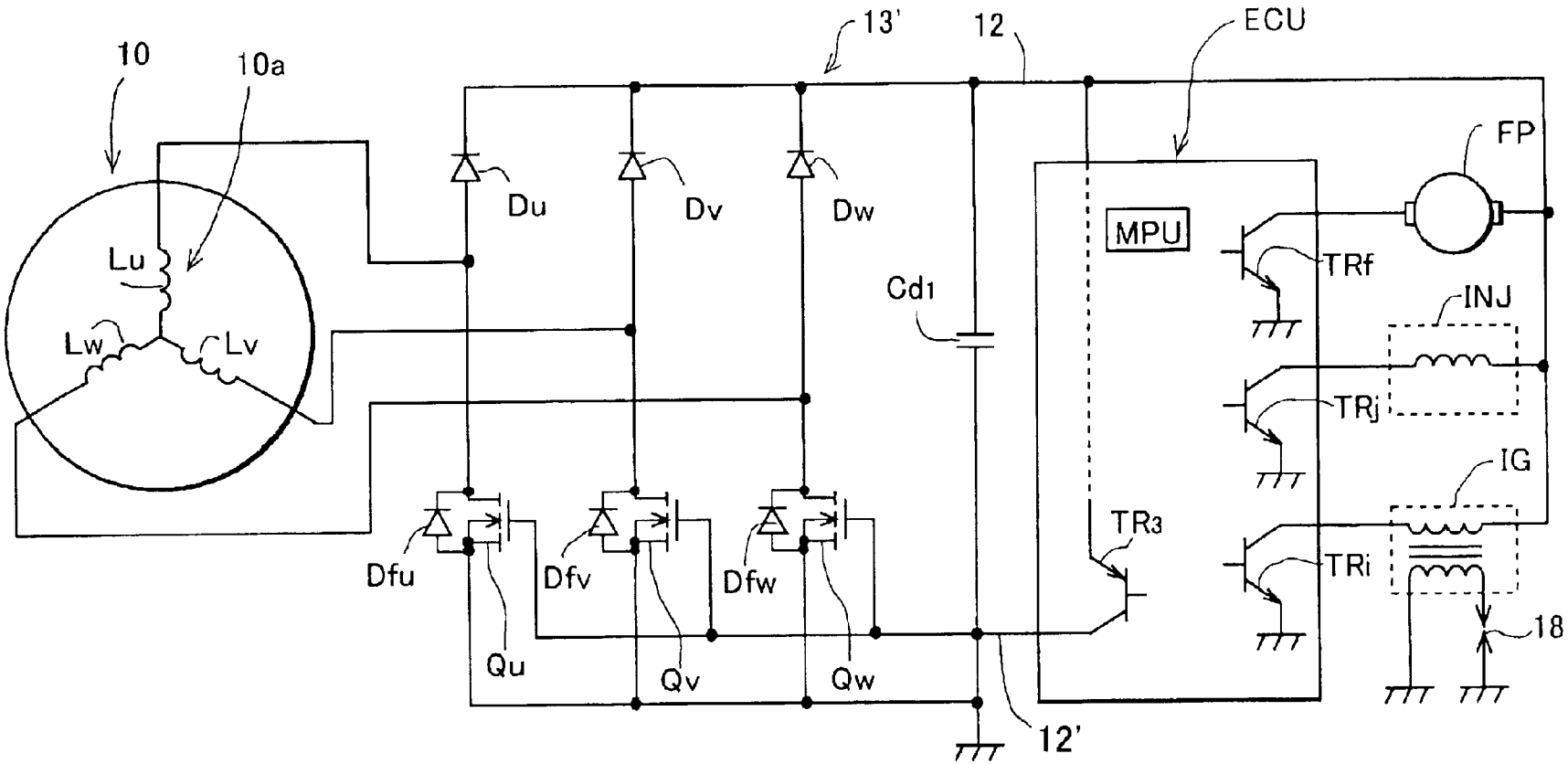
FIG. 3 is a schematic diagram of a fuel injection and ignition system for an internal combustion engine constructed in accordance with a third embodiment of the invention.

FIG. 3 shows another embodiment of the invention in which the power source circuit 13' comprises rectifiers Du through Dw to rectify the output current of the generator 10 and chopper switches Qu through Qw to intermittently flow the output current of the generator whereby the voltage rectified by the rectifiers and regulated by the chopper switches is output to the power source line 12.

In the illustrated embodiment, the power source circuit 13' is formed by the hybrid bridge circuit including the rectifiers Du through Dw formed of an upper arm of the bridge and the chopper switches Qu through Qw formed of a lower arm of the bridge, and the output of the three phase generation coil 10*a* in the generator 10 is input to AC terminals of the power source circuit. The smoothing capacitor Cd1 is connected between the output terminals of the power source circuit 13', and the power source voltage is applied from the power source circuit 13' through the power source line 12 to the controller ECU, the fuel pump FP, the injector INJ and the ignition coil IG.

In the illustrated embodiment, the chopper switches Qu through Qw comprise a MOSFET and gates of FETs forming the switches Qu through Qw, respectively are connected collectively to the collector of the control PNP transistor TR3 so that the switches Qu through Qw are turned on and off by turning on and off the transistor TR3.

In FIG. 3, Dfu through Dfw designate parasitic diodes formed between a drain and a source of the MOSFETs forming the switches Qu through Qw, respectively.

In the embodiment illustrated in FIG. 3, in the controller ECU, there is provided chopper control means to control the chopper switches Qu through Qw so as to boost the voltage of the power source line 12 when the rotational speed of the internal combustion engine is low and the voltage of the power source line 12 is lower than the predetermined limited value and so as to lower the voltage of the power source line 12 when it exceeds the limited value. This chopper control means may be provided in the power source section (outside of the controller ECU).

Since the control of the chopper switches can begin after the output (5V) of the control power source circuit in the ECU rises so that the microprocessor starts, the operation of boosting the output voltage of the generator immediately after the initiation operation of the engine begins so that the high power source voltage can be output to the power source line 12.

Figure 4:
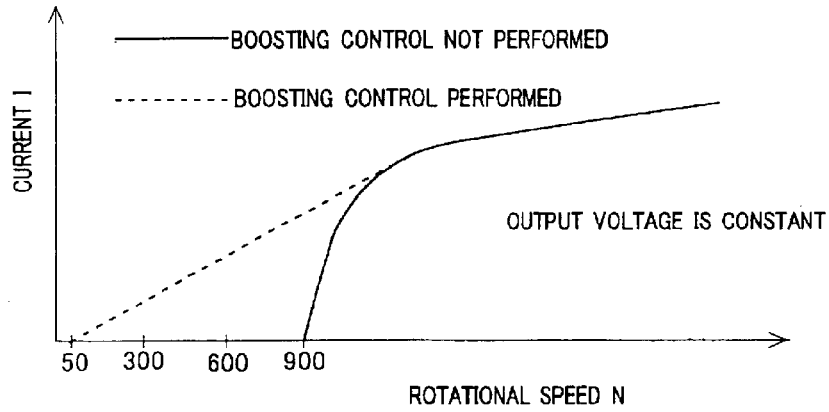
FIG. 4 illustrates an effect obtained in the case where the system is constructed as in the third embodiment of the invention.

In the embodiments illustrated in FIGS. 1 and 2, as shown by a solid line in FIG. 4, unless the rotational speed N of the engine increases to a certain degree (900 r.p.m in the illustrated embodiment), the current I cannot be supplied from the power source line 12 to the load, but with the chopper boosting control performed as aforementioned, the current can be supplied to the load even at the low speed area when the engine starts as indicated by a dotted line of FIG. 4 and therefore the startability of the engine can be improved and the compactness of the generator can be accomplished.

In the aforementioned embodiments, a current interruption type circuit is used as the ignition circuit, but it may be a capacitor discharge type ignition circuit. In the case where there is used the capacitor discharge type ignition circuit in which an igniting capacitor is charged by the AC output of the magneto generator, the generation coil for charging the igniting capacitor may be provided in the generator 10 so that the igniting capacitor is charged by the output of the generation coil.

According to the invention, since the power source section is so constructed as to apply the power source voltage to the controller and the fuel pump and at least one of the injector and the ignition circuit from the single voltage regulating power source circuit having the generator as the power source through the power source line, the number of the power source circuits provided in the power source section can be lowered so as to reduce the cost of the system.

Also, according to the invention, since the number of the generation coils provided in the different systems in the generator can be lowered so that the number of the winding operations of the generator can be reduced, the number of harnesses led out of the generator can be lowered and the cost of the generator is reduced.

In addition thereto, since the operation of the fuel pump can be continued even when the fuel injection and the ignition operation are performed in the course of starting the internal combustion engine, there can be prevented the state of shortage of the fuel pressure, which occurs in the prior art in which the fuel pump stops when the fuel injection is performed or when the ignition is performed in the course of starting the engine. Thus, the possible shortage of the fuel injection amount when the engine should be started can be avoided, which causes the startability of the engine to be improved.

Although some preferred embodiments of the invention have been described and illustrated with reference to the accompanying drawings, it will be understood by those skilled in the art that they are by way of examples, and that various changes and modifications may be made without departing from the spirit and scope of the invention, which is defined only to the appended claims.

What is claimed is:

1. A fuel injection and ignition system for an internal combustion engine comprising an injector to supply fuel to said internal combustion engine, a fuel pump to supply said fuel to said injector, an ignition circuit to generate an igniting high voltage to be applied across an ignition plug provided in a cylinder of said internal combustion engine, a controller to control at least said injector and said ignition circuit, and a power source section having an AC generator driven by said internal combustion engine as a power source to apply a power source voltage to said injector, said fuel pump, said ignition circuit and said controller;

said power source section adapted to apply said power source voltage from a single voltage regulating power source circuit through a power source line to said controller and said fuel pump and at least one of said injector and said ignition circuit; and said controller comprising pump drive current control means to control a drive current for said fuel pump in a PWM mode so as to maintain said voltage of said power source line at a reference voltage or more, which is determined at a voltage or more corresponding to the minimum operation voltage of elements other than said fuel pump, in the course of starting said engine.

2. A fuel injection and ignition system for an internal combustion engine as set forth in claim 1, wherein said power source circuit comprises a control rectifier circuit having a hybrid bridge circuit of diodes and thyristors and outputting said power source voltage to said power source line, and wherein thyristor control means is provided in said power source section or said controller to control said thyristors so as to limit said voltage of said power source line at said predetermined limited value or less.

3. A fuel injection and ignition system for an internal combustion engine as set forth in claim 1, wherein said generator comprises a magneto generator, wherein said power source circuit comprises a rectifier circuit to rectify said output voltage of said generator and an output shorting switch to short said output of said generator so that said power source voltage is output from said rectifier circuit to said power source line, and wherein output shorting switch control means is provided in said power source section or said controller to control said output shorting switch so as to short said output of said generator when said voltage of said power source line exceeds said predetermined limited value.

4. A fuel injection and ignition system for an internal combustion engine as set forth in claim 1, wherein said power source circuit comprises a rectifier to rectify said output current of said generator and a chopper switch to intermittently flow said output current of said generator so that a voltage rectified by said rectifier and regulated by said chopper switch is output to said power source line, and wherein chopper control means is provided in said power source section or said controller to control said chopper switch so as to boost said voltage of said power source line when the rotational speed of said internal combustion engine is low and said voltage of said power source line is less than said predetermined limited value and to lower said voltage of said power source line when said voltage of said power source line exceeds said limited value.

5. A fuel injection and ignition system for an internal combustion engine comprising an injector to supply a fuel to said internal combustion engine, a fuel pump to supply said fuel to said injector, an ignition circuit to generate an igniting high voltage to be applied across an ignition plug provided in a cylinder of the internal combustion engine, a controller to control at least said injector and said ignition circuit, and a power source section having an AC generator driven by said internal combustion engine as a power source to apply a power source voltage to said injector, said fuel pump, said ignition circuit and said controller;

said power source section adapted to apply said power source voltage from a single voltage regulating power source circuit through a power source line to said controller and said fuel pump and at least one of said injector and said ignition circuit;

a load or loads other than said injector, said ignition circuit, said controller and said fuel pump being connected through energization control switch means to said power source line; and said controller comprising pump drive current control means to control a drive current for said fuel pump in a PWM mode so as to maintain said voltage of said power source line at a reference voltage or more, which is determined at a voltage or more corresponding to the minimum operation voltage of elements other than said fuel pump, in the course of starting said engine and energization control switch control means to control an energization control switch in a PWM mode so as to keep an off state of said energization control switch when said engine should be started and keep said voltage of said power source line at an objective voltage set at said reference voltage or more after said engine completes starting.

6. A fuel injection and ignition system for an internal combustion engine as set forth in claim 5, wherein said power source circuit comprises a control rectifier circuit having a hybrid bridge circuit of diodes and thyristors and outputting said power source voltage to said power source line, and wherein thyristor control means is provided in said power source section or said controller to control said thyristors so as to limit said voltage of said power source line at said predetermined limited value or less.

7. A fuel injection and ignition system for an internal combustion engine as set forth in claim 5, wherein said generator comprises a magneto generator, wherein said power source circuit comprises a rectifier circuit to rectify said output voltage of said generator and an output shorting switch to short said output of said generator so that said power source voltage is output from said rectifier circuit to said power source line, and wherein output shorting switch control means is provided in said power source section or said controller to control said output shorting switch so as to short said output of said generator when said voltage of said power source line exceeds said predetermined limited value.

8. A fuel injection and ignition system for an internal combustion engine as set forth in claim 5, wherein said power source circuit comprises a rectifier to rectify said output current of said generator and a chopper switch to intermittently flow said output current of said generator so that a voltage rectified by said rectifier and regulated by said chopper switch is output to said power source line, and wherein chopper control means is provided in said power source section or said controller to control said chopper switch so as to boost said voltage of said power source line when the rotational speed of said internal combustion engine is low and said voltage of said power source line is less than said predetermined limited value and to lower said voltage of said power source line when said voltage of said power source line exceeds said limited value.

9. A fuel injection and ignition system for an internal combustion engine comprising an injector to supply a fuel to said internal combustion engine, a fuel pump to supply said fuel to said injector, an ignition circuit to generate an igniting high voltage to be applied across an ignition plug provided in a cylinder of the internal combustion engine, a controller to control at least said injector and said ignition circuit, and a power source section having an AC generator driven by said internal combustion engine as a power source to apply a power source voltage to said injector, said fuel pump, said ignition circuit and said controller;

said power source section adapted to apply said power source voltage from a single voltage regulating power source circuit through a power source line to said injector, said ignition circuit, said controller and said fuel pump; and said controller comprising pump drive current control means to control a drive current of said fuel pump in a PWM mode so as to maintain said voltage of said power source line at a reference voltage or more, which is determined at a voltage or more corresponding to a higher operation voltage among the minimum operation voltages of said injector and said ignition circuit in the course of starting said engine.

10. A fuel injection and ignition system for an internal combustion engine as set forth in claim 9, wherein said power source circuit comprises a control rectifier circuit having a hybrid bridge circuit of diodes and thyristors and outputting said power source voltage to said power source line, and wherein thyristor control means is provided in said power source section or said controller to control said thyristors so as to limit said voltage of said power source line at said predetermined limited value or less.

11. A fuel injection and ignition system for an internal combustion engine as set forth in claim 9, wherein said generator comprises a magneto generator, wherein said power source circuit comprises a rectifier circuit to rectify said output voltage of said generator and an output shorting switch to short said output of said generator so that said power source voltage is output from said rectifier circuit to said power source line, and wherein output shorting switch control means is provided in said power source section or said controller to control said output shorting switch so as to short said output of said generator when said voltage of said power source line exceeds said predetermined limited value.

12. A fuel injection and ignition system for an internal combustion engine as set forth in claim 9, wherein said power source circuit comprises a rectifier to rectify said output current of said generator and a chopper switch to intermittently flow said output current of said generator so that a voltage rectified by said rectifier and regulated by said chopper switch is output to said power source line, and wherein chopper control means is provided in said power source section or said controller to control said chopper switch so as to boost said voltage of said power source line when the rotational speed of said internal combustion engine is low and said voltage of said power source line is less than said predetermined limited value and to lower said voltage of said power source line when said voltage of said power source line exceeds said limited value.

13. A fuel injection and ignition system for an internal combustion engine comprising an injector to supply a fuel to said internal combustion engine, a fuel pump to supply said fuel to said injector, an ignition circuit to generate an igniting high voltage to be applied across an ignition plug provided in a cylinder of the internal combustion engine, a controller to control at least said injector and said ignition circuit, and a power source section having an AC generator driven by said internal combustion engine as a power source to apply a power source voltage to said injector, said fuel pump, said ignition circuit and said controller;

said power source section adapted to apply said power source voltage from a single voltage regulating power source circuit through a power source line to said injector, said ignition circuit, said controller and said fuel pump;

a load or loads other than said injector, said ignition circuit, said controller and said fuel pump being connected through energization control switch means to said power source line; and said controller comprising pump drive current control means to control a drive current of said fuel pump in a PWM mode so as to maintain said voltage of said power source line at a reference voltage or more, which is determined at a voltage or more corresponding to a higher operation voltage among the minimum operation voltages of said injector and said ignition circuit in the course of starting said engine and energization control switch control means to control an energization control switch in a PWM mode so as to keep an off state of said energization control switch when said engine should be started and keep said voltage of said power source line at an objective voltage set at said reference voltage or more after said engine completes starting.

14. A fuel injection and ignition system for an internal combustion engine as set forth in claim 13, wherein said power source circuit comprises a control rectifier circuit having a hybrid bridge circuit of diodes and thyristors and outputting said power source voltage to said power source line, and wherein thyristor control means is provided in said power source section or said controller to control said thyristors so as to limit said voltage of said power source line at said predetermined limited value or less.

15. A fuel injection and ignition system for an internal combustion engine as set forth in claim 13, wherein said generator comprises a magneto generator, wherein said power source circuit comprises a rectifier circuit to rectify said output voltage of said generator and an output shorting switch to short said output of said generator so that said power source voltage is output from said rectifier circuit to said power source line, and wherein output shorting switch control means is provided in said power source section or said controller to control said output shorting switch so as to short said output of said generator when said voltage of said power source line exceeds said predetermined limited value.

16. A fuel injection and ignition system for an internal combustion engine as set forth in claim 13, wherein said power source circuit comprises a rectifier to rectify said output current of said generator and a chopper switch to intermittently flow said output current of said generator so that a voltage rectified by said rectifier and regulated by said chopper switch is output to said power source line, and wherein chopper control means is provided in said power source section or said controller to control said chopper switch so as to boost said voltage of said power source line when the rotational speed of said internal combustion engine is low and said voltage of said power source line is less than said predetermined limited value and to lower said voltage of said power source line when said voltage of said power source line exceeds said limited value.

17. A fuel injection and ignition system for an internal combustion engine comprising an injector to supply fuel to said internal combustion engine, a fuel pump to supply said fuel to said injector, an ignition circuit to generate an igniting high voltage to be applied across an ignition plug provided in a cylinder of the internal combustion engine, a controller to control at least said injector and said ignition circuit, and a power source section having an AC generator driven by said internal combustion engine as a power source to apply a power source voltage to said injector, said fuel pump, said ignition circuit and said controller;

said power source section adapted to apply said power source voltage from a voltage regulating power source circuit comprising said generator as a power source through a power source line to one of said injector and said ignition circuit, said controller and said fuel pump and apply said power source voltage to the other of said injector and said ignition circuit through a circuit of a system separate from said power source circuit; and said controller comprising pump drive current control means to control a drive current of said fuel pump in a PWM mode so as to maintain said voltage of said power source line at a reference voltage or more, which is determined at a voltage or more corresponding to the minimum operation voltage of elements other than said fuel pump, in the course of starting said engine.

18. A fuel injection and ignition system for an internal combustion engine as set forth in claim 17, wherein said power source circuit comprises a control rectifier circuit having a hybrid bridge circuit of diodes and thyristors and outputting said power source voltage to said power source line, and wherein thyristor control means is provided in said power source section or said controller to control said thyristors so as to limit said voltage of said power source line at said predetermined limited value or less.

19. A fuel injection and ignition system for an internal combustion engine as set forth in claim 17, wherein said generator comprises a magneto generator, wherein said power source circuit comprises a rectifier circuit to rectify said output voltage of said generator and an output shorting switch to short said output of said generator so that said power source voltage is output from said rectifier circuit to said power source line, and wherein output shorting switch control means is provided in said power source section or said controller to control said output shorting switch so as to short said output of said generator when said voltage of said power source line exceeds said predetermined limited value.

20. A fuel injection and ignition system for an internal combustion engine as set forth in claim 17, wherein said power source circuit comprises a rectifier to rectify said output current of said generator and a chopper switch to intermittently flow said output current of said generator so that a voltage rectified by said rectifier and regulated by said chopper switch is output to said power source line, and wherein chopper control means is provided in said power source section or said controller to control said chopper switch so as to boost said voltage of said power source line when the rotational speed of said internal combustion engine is low and said voltage of said power source line is less than said predetermined limited value and to lower said voltage of said power source line when said voltage of said power source line exceeds said limited value.

21. A fuel injection and ignition system for an internal combustion engine comprising an injector to supply a fuel to said internal combustion engine, a fuel pump to supply said fuel to said injector, an ignition circuit to generate an igniting high voltage to be applied across an ignition plug provided in a cylinder of the internal combustion engine, a controller to control at least said injector and said ignition circuit, and a power source section having an AC generator driven by said internal combustion engine as a power source to apply a power source voltage to said injector, said fuel pump, said ignition circuit and said controller;

said power source section adapted to apply said power source voltage from a voltage regulating power source circuit comprising said generator as a power source through a power source line to one of said injector and said ignition circuit, said controller and said fuel pump and apply said power source voltage to the other of said injector and said ignition circuit through a circuit of a system separate from said power source circuit;

a load or loads other than said injector, said ignition circuit, said controller and said fuel pump being connected through energization control switch means to said power source line; and said controller comprising pump drive current control means to control a drive current of said fuel pump in a PWM mode so as to maintain said voltage of said power source line at a reference voltage or more, which is determined at a voltage or more corresponding to the minimum operation voltage of elements other than said fuel pump, in the course of starting said engine and energization control switch control means to control an energization control switch in a PWM mode so as to keep an off state of said energization control switch when said engine should be started and keep said voltage of said power source line at an objective voltage set at said reference voltage or more after said engine completes starting.

22. A fuel injection and ignition system for an internal combustion engine as set forth in claim 21, wherein said power source circuit comprises a control rectifier circuit having a hybrid bridge circuit of diodes and thyristors and outputting said power source voltage to said power source line, and wherein thyristor control means is provided in said power source section or said controller to control said thyristors so as to limit said voltage of said power source line at said predetermined limited value or less.

23. A fuel injection and ignition system for an internal combustion engine as set forth in claim 21, wherein said generator comprises a magneto generator, wherein said power source circuit comprises a rectifier circuit to rectify said output voltage of said generator and an output shorting switch to short said output of said generator so that said power source voltage is output from said rectifier circuit to said power source line, and wherein output shorting switch control means is provided in said power source section or said controller to control said output shorting switch so as to short said output of said generator when said voltage of said power source line exceeds said predetermined limited value.

24. A fuel injection and ignition system for an internal combustion engine as set forth in claim 21, wherein said power source circuit comprises a rectifier to rectify said output current of said generator and a chopper switch to intermittently flow said output current of said generator so that a voltage rectified by said rectifier and regulated by said chopper switch is output to said power source line, and wherein chopper control means is provided in said power source section or said controller to control said chopper switch so as to boost said voltage of said power source line when the rotational speed of said internal combustion engine is low and said voltage of said power source line is less than said predetermined limited value and to lower said voltage of said power source line when said voltage of said power source line exceeds said limited value.

* * * * *